United States Patent [19]

Oya

[11] 4,134,320

[45] Jan. 16, 1979

[54] KEY ASSIGNER FOR USE IN ELECTRONIC MUSICAL INSTRUMENT

[75] Inventor: Akiyoshi Oya, Hamamatsu, Japan

[73] Assignee: Nippon Gakki Seizo Kabushiki Kaisha, Hamamatsu, Japan

[21] Appl. No.: 605,957

[22] Filed: Aug. 19, 1975

[30] Foreign Application Priority Data

Aug. 19, 1974 [JP] Japan ..... 49/94747
Sep. 4, 1974 [JP] Japan ..... 49/101734
Sep. 6, 1974 [JP] Japan ..... 49/102639

[51] Int. Cl.[2] ..... G10H 1/00
[52] U.S. Cl. ..... 84/1.01; 340/365 S
[58] Field of Search ..... 84/1.01, 1.03, 1.24; 340/365 R, 365 S

[56] References Cited

U.S. PATENT DOCUMENTS

| | | | |
|---|---|---|---|
| 3,610,799 | 10/1971 | Watson | 84/1.01 |
| 3,750,160 | 7/1973 | Elzinga | 340/365 S X |
| 3,816,637 | 6/1974 | Whitefield | 84/1.24 |
| 3,882,751 | 5/1975 | Tomisawa et al. | 84/1.01 |
| 3,899,951 | 8/1975 | Griffith et al. | 84/1.01 |
| 3,951,028 | 4/1976 | Robinson | 84/1.01 |
| 3,955,460 | 5/1976 | Southard | 340/365 S X |
| 4,011,784 | 3/1977 | Fukui | 84/1.01 |

*Primary Examiner*—Stanley J. Witkowski
*Attorney, Agent, or Firm*—Ladas, Parry, Von Gehr, Goldsmith & Deschamps

[57] ABSTRACT

In an electronic musical instrument, key switches are scanned sequentially and repetitively in a high scanning rate to deliver key data consisting of a pulse existence at an assigned time slot and representing ON-OFF states of the key switches. The key data is converted into key codes of digital notation. The key codes are assigned to and memorized in time-shared channels of a high time-sharing rate. A time-sharing rate converter reads out the key codes of digital notation and produces key gate control signals at corresponding ones of individual output terminal in a low time-sharing rate.

8 Claims, 5 Drawing Figures

KEY ASSIGNER FOR USE IN ELECTRONIC MUSICAL INSTRUMENT

BACKGROUND OF THE INVENTION

This invention relates to a key assigner for use in an electronic musical instrument which generates musical tones in response to voltages representing the notes of depressed keys and is generally called a musical synthesizer, and, more particularly, to a key assigner with an improved response characteristic of analog circuits for sampling and holding note voltages.

The electronic musical instrument to which the novel key assigner of this invention is applicable is of the type disclosed in my copending patent application Ser. No. 601,945, filed Aug. 4, 1975, in which independent note voltage generating circuits and key gate circuit are provided, a note voltage, (i.e., a voltage representing a note and determining an oscillator frequency) being sampled by a key gate circuit corresponding to each key, the sampled note voltage being further sampled by channel gate circuit respectively corresponding to a plurality of channels equal in number to the maximum number of tones to be generated simultaneously, the sampled note voltage being held by charging capacitors provided for respective channels and the note voltage corresponding to a depressed key being sampled by controlling the key gate circuits in synchronism with the control of the channel gate circuits and in accordance with a scanning operation for detecting the ON-OFF states of the key switches, whereby a plurality of tones are simultaneously generated by voltage controlled oscillators in accordance with the note voltage held by the capacitors.

For the purpose of controlling a plurality of key gate circuits in accordance with the depressed keys, it is necessary to scan all switches and detect the ON-OFF states of the respective keys for producing gate control signals. However, a high speed scanning is generally necessary to scan and detect a plurality of key switches in time sharing without affording a feeling of unnaturalness to the audience. On the other hand, in order to sample the note voltage in synchronization with the gate control and to charge respective capacitors with the sampled voltages, it is necessary to decrease the sampling speed by taking into consideration the charge voltage response characteristic determined by the resistance time constant of the analog circuits including the capacitors and the gate circuits.

According to the invention described in said copending patent application, for the purpose of decreasing the sampling speed, respective key codes are statically held by temporarily latching the key codes in respective channels which are delivered at a high synchronous rate, and the key codes of respective channels thus latched are multiplexed in time-sharing at a low synchronous rate by the operation of a plurality of multiplexing circuits and the multiplexed codes are decoded to produce gate control signals corresponding to the key codes. However, according to that procedure, it is necessary to latch and statically hold the key codes of respective channels and, accordingly, latching circuits of the same number as the channels must be provided. This makes the circuit construction complicated and expensive. Moreover, this method is defective in that the musical tone frequency fluctuates in the rise portion of the tone due to the adverse effect of transient voltages produced at the time of charging capacitors.

SUMMARY OF THE INVENTION

Accordingly, it is an object of this invention to provide an improved key assigner for use in the electronic musical instrument of the type referred to above which has a simple circuit construction and can convert the time-sharing rate of key detection by the high speed scanning of the key switches into a low speed time sharing rate of a gate control signal utilized for sampling the note voltage.

Another object of this invention is to provide an improved key assigner for use in an electronic musical instrument of the type referred to above and capable of producing an envelope gate control signal so as to produce a musical tone only upon stabilization of the musical tone frequency in the rise portion of the tone.

According to this invention, there is provided a key code assigner for use in an electronic musical instrument comprising means for successively scanning all key switches of the musical instrument thereby producing key data which consists of a pulse existence at an assigned time slot and represents the ON-OFF states of the respective key switches, means operated synchronously with the scanning operation for producing sequentially changing key codes corresponding to the respective key switches, key code memory means responsive to the key data for storing the key codes corresponding to the key switches which are turned ON in corresponding ones of channels equal in number to the maximum number of tones to be reproduced simultaneously, means for sequentially deriving the key codes of the respective channels from the key code memory means in time sharing and in synchronism with the scanning operation, means for generating low rate sampling pulses which are synchronous in a spaced time relation with respective channel periods of a high time-sharing rate corresponding to the scanning, means for successively storing and holding key codes of the channels which are derived from the key code memory means when the sampling pulses are applied, and means for decoding the key codes stored and held in the last mentioned means for producing key gate control signals.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
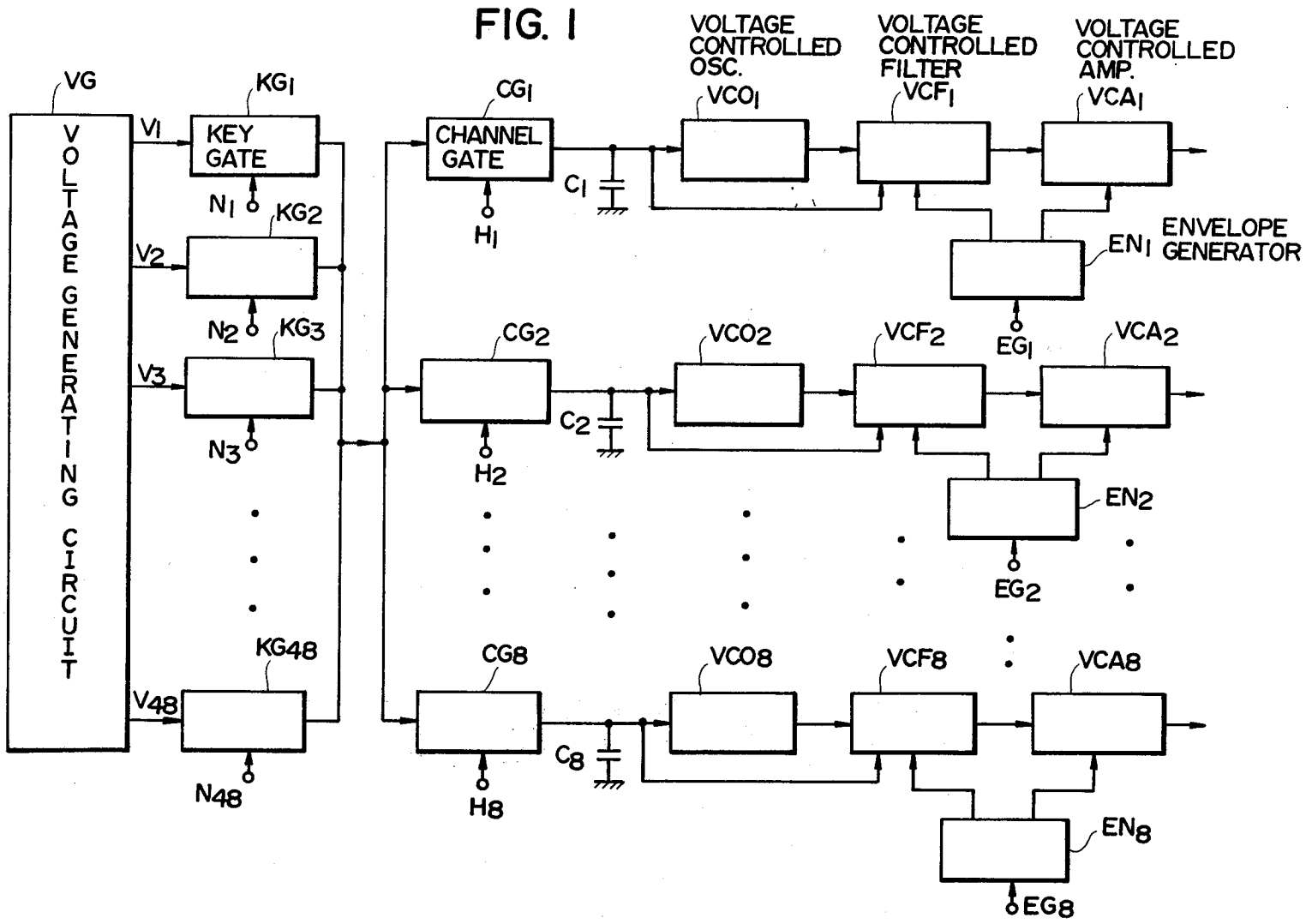
FIG. 1 is a block diagram showing a musical tone producing portion of an electronic musical instrument to be associated with the novel key assigner of this invention.

The electronic musical instrument shown in FIG. 1 is provided with 48 keys and comprises a voltage generating circuit VG for generating note voltages $V_1$ through $V_{48}$ corresponding to respective keys, not shown, and a plurality of key gate circuits $KG_1$ through $KG_{48}$ which are enabled when they are supplied with corresponding key gate control signals $N_1$ through $N_{48}$, respectively, for passing or sampling the note voltages $V_1$ through $V_{48}$ respectively. Key gate control signals $N_1$ through $N_{48}$ are applied to respective key gate circuits one at a time as will be described later. The outputs of the key gate circuits $KG_1$ through $KG_{48}$ are applied to channel gate circuits $CG_1$ through $CG_8$ corresponding to respective channels which are equal in number to the maximum number of tones to be reproduced simultaneously, (8 in the present example). These channel gates function to further sample the sampled note voltages. More particularly, the channel gate circuits $CG_1$ through $CG_8$ which receive channel gate signals $H_1$ through $H_8$ are enabled for charging corresponding ones of a plurality of capacitors $C_1$ through $C_8$. As will be described later, these channel gate signals $H_1$ through $H_8$ are applied in synchronism with the key gate control signals. The note voltages charged in and held by capacitors $C_1$ through $C_8$ of respective channels are applied to voltage-controlled oscillators $VCO_1$ through $VCO_8$ respectively thereby causing these oscillators to generate signals respectively having frequencies determined by respective note voltages. The output signals from oscillator $VCO_1$ through $VCO_8$ are passed successively through voltage-controlled filters $VCF_1$ through $VCF_8$ and voltage-controlled amplifiers $VCA_1$ through $VCA_8$, respectively so that the output signals are suitably filtered and amplified to produce tones through an acoustic device, not shown. Further, there are provided eight envelope generators $EN_1$ through $EN_8$ which are constructed to generate predetermined envelope signals when they are supplied with envelope gate control signals $EG_1$ through $EG_8$ (to be described later). As a consequence, the voltage-controlled filters $VCF_1$ through $VCF_8$ operate to control the tone color in accordance with the envelope signals whereas the voltage-controlled amplifiers $VCA_1$ through $VCA_8$ function to control the volume of the tone in accordance with the envelope signals.

Figure 2:
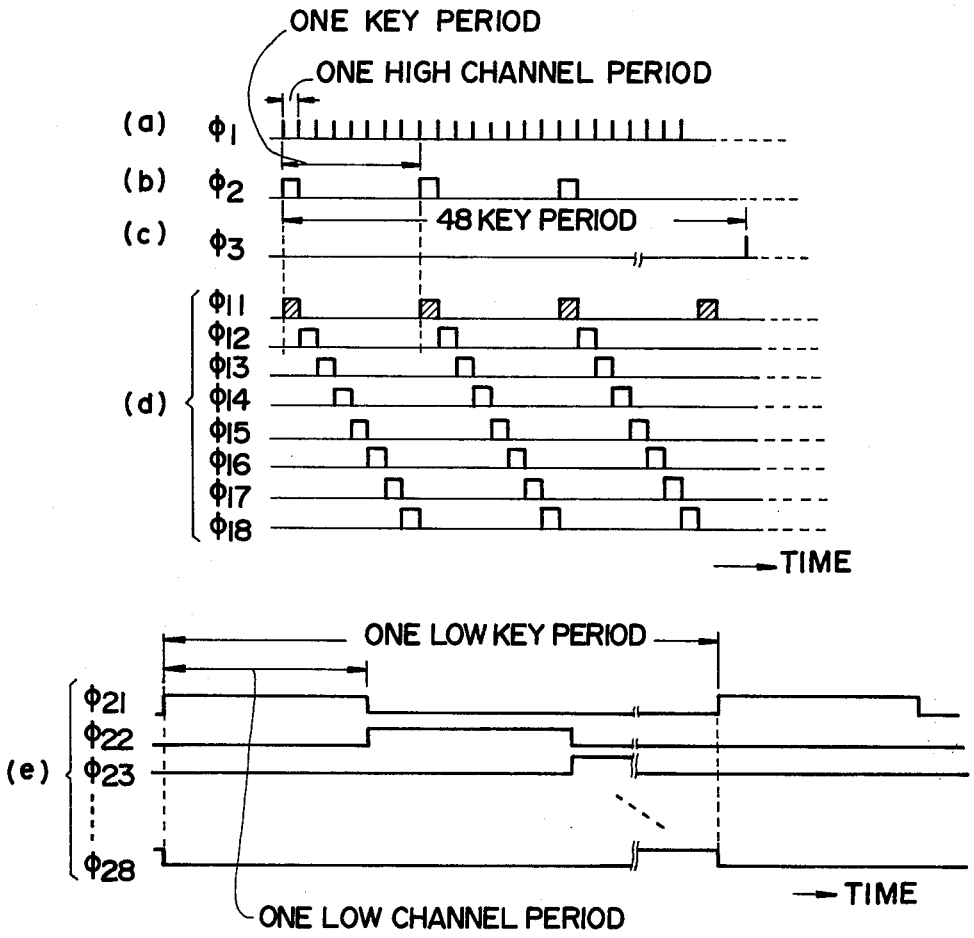
FIGS. 2*a* through 2*e* show various clock pulses utilized in the novel key assigner of this invention.

Various clock pulses utilized in the novel key assigner will now be described with reference to FIG. 2. FIG. 2*a* shows a high channel clock pulse 4, (e.g. 1 us), interval thereof being termed a high channel the recurrence period. FIG. 2*b* shows a key clock pulse $\phi_2$, (e.g. 8 us) the pulse width thereof being one high channel period. The recurrence interval of the key clock pulse $\phi_2$ is termed a key period. FIG. 2*c* shows a key scanning clock pulse $\phi_3$, (e.g. 384 us) the recurrence interval thereof being 48 key periods. FIG. 2*d* shows first to eight high channel synchronizing clock pulses $\phi_{11}$ though $\phi_{18}$. These clock pulses are sequentially generated by counting the high channel clock pulse $\phi_1$ by an octanary counter, not shown, and then decoding the result of counting. The recurrence interval of the clock pulses $\phi_{11}$–$\phi_{18}$ is equal to one key period and the pulse width thereof is equal to one high channel period. FIG. 2*e* shows first to eight low channel synchronizing clock pulses $\phi_{21}$ through $\phi_{28}$ which are depicted with a reduced time scale relative to that of the clock pulses $\phi_1$ through $\phi_{18}$. These low channel synchronizing pulses have much lower frequencies (about 1/1000) than the key clock pulse $\phi_2$ for example and have a pulse width of one low channel period and a recurrence interval of one low key period.

Figure 3:
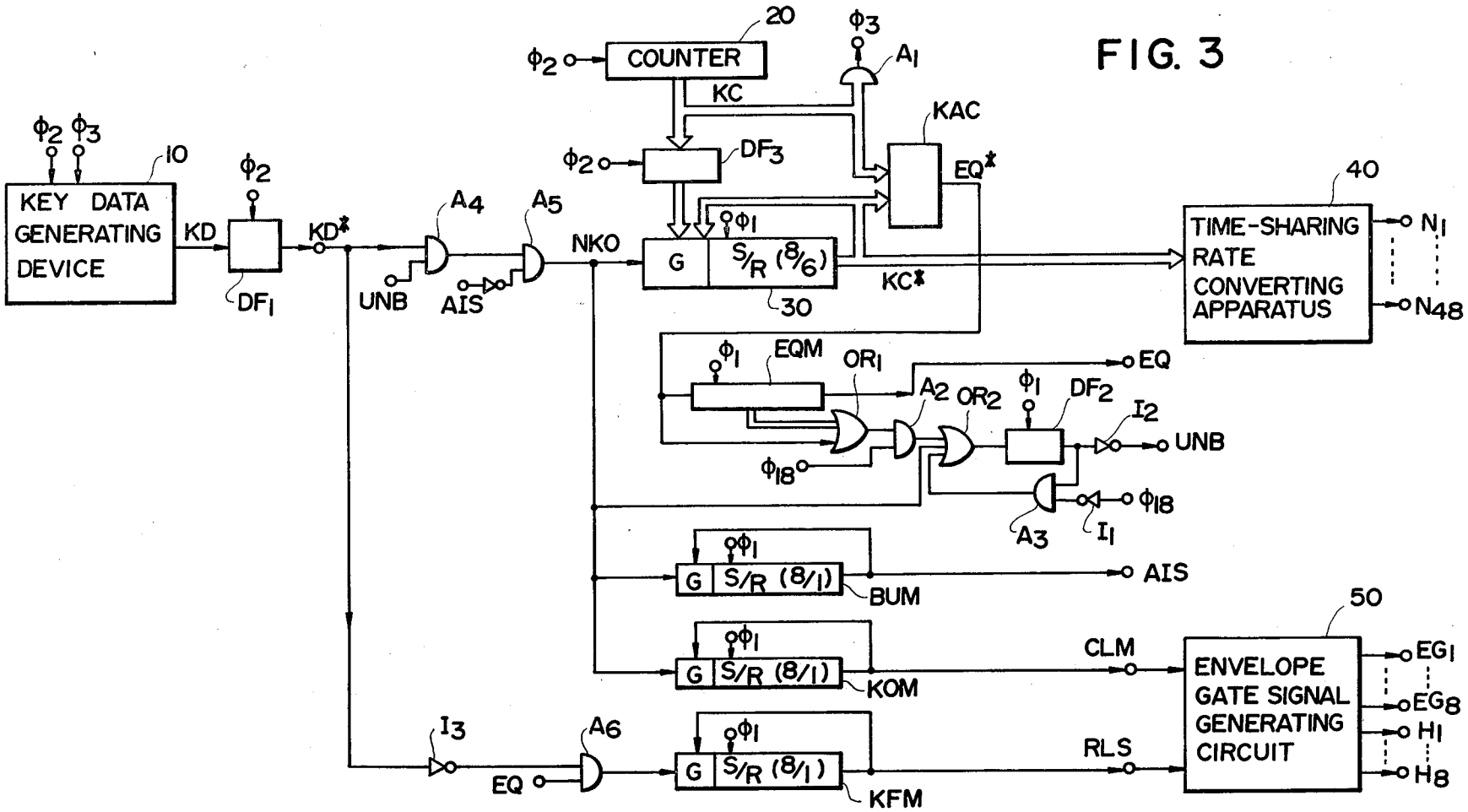
FIG. 3 is a block diagram showing one embodiment of the key assigner of this invention.

FIG. 3 shows one example of the key assigner incorporated in the apparatus according to the invention. The figure particularly illustrates details of construction for generating key code KC*, claim signal CLM and release signal RLS which are produced in time-shared sequence at a high rate. A key data generator 10 sequentially scans ON-OFF states of key switches respectively interlocked with keys at a scanning rate of a key clock pulse $\phi_2$ and produces results of scanning of the key switches, i.e., key data KD, in time-shared multiplexing. More specifically, outputs of a 48 modulo counter sequentially counting the key clock pulse $\phi_2$ are decoded and the decoded signals are used for scanning the key switches provided in a key switch matrix circuit (not shown). This 48 modulo counter is reset by a key scanning clock pulse $\phi_3$ and performs its counting operation in complete synchronization with the counting operation of a key code generator 20. A pulse is produced in a time slot corresponding to a switch which is ON (signal "1") and no pulse is produced in a time slot corresponding to a switch is OFF (signal "0"). These signals constitute the key data KD.

The key data KD thus produced is delayed in a delay flip-flop $DF_1$ by one key time and provided as delayed key data KD*.

The key code generator 20 consisting of a 48 modulo counter sequentially counts the key clock pulse $\phi_2$ and produces 48 different 6-bit key codes corresponding to the respective keys. The key scanning clock pulse $\phi_3$ is produced from an AND circuit $A_1$ by detecting in the AND circuit $A_1$ a state in which the respective bits of the key code are all zero. This key scanning clock pulse $\phi_3$ is applied to the key data generator 10. The key code KC is generated in synchronization with the scanning of the key switches so that the key data KD and the key code KC produced at the same time point correspond to the same key switch.

A key code memory 30 is capable of storing the key codes in its channels equal in number to a maximum number of tones to be reproduced simultaneously. A shift register of eight stages (1 stage being constituted by 6 bits), for example, is employed as the key code memory 30. Contents of this shift register are sequentially shifted in response to the high channel clock pulse $\phi_1$ and the output key code code KC* delivered out of the final stage of the shift register is applied to a latch circuit 41 in a time-sharing rate converting apparatus 40 to be described later and also fed back to the input terminal of the shift register.

Assume that key date KD which is a signal "1" has now been produced. The key code KC generated from the key code generator 20 during one key time represents a key switch corresponding to the key data which is ON. Since the key data KD is delayed by one key time, the key code KC applied during this time to a comparison circuit KAC is compared with each output of the channels of the key code memory 30. A coincidence signal EQ* produces from the comparison circuit KAC is "1" when there is coincidence and "0" when there is no coincidence. The coincidence signal EQ* is applied to a coincidence detection memory EQM. This memory EQM is a shift register having a suitable number of stages, e.g., 8 as in this embodiment. The memory EQM successively shifts the signal EQ*, i.e., delays it by one key time when the signal EQ* is "1" and thereby produces a coincidence signal EQ (=1). Each of the outputs from the first to seventh stages of the coincidence detection memory EQM is applied to the OR circuit $OR_1$. Accordingly, the OR circuit $OR_1$ produces an output when either the signal EQ* from the comparison circuit KAC or one of the outputs from the first to seventh stages of the shift register EQM is "1." The output signal of the OR circuit $OR_1$ is applied to one of the input terminals of an AND circuit $A_2$. The AND circuit $A_2$ receives an eight high channel synchronizing clock pulse $\phi_{18}$ at the other input terminal thereof. Since information stored in the shift register before the first channel is false information, correct information, i.e., information representing the result of comparison between the key code KC and the codes in the respective channels of the key code memory 30 is obtained only when the result of the comparison in each of the first to seventh channels is applied to the coincidence detection memory EQM and the result of comparison in the eighth channel is applied directly to the OR circuit $OR_1$. This is the reason why the clock $\phi_{18}$ is applied to the AND circuit $A_2$.

If the output of the OR circuit $OR_1$ is "1" when the clock pulse $\phi_{18}$ is applied, the AND circuit $A_2$ produces an output "1" which is applied through an OR circuit $OR_2$ to a delay flip-flop $DF_2$. The signal is delayed by this delay flip-flop $DF_2$ by one high channel time and fed back thereto via an AND circuit $A_3$. Thus, the signal "1" is stored during one key time until a next clock pulse $\phi_{18}$ is applied to the AND circuit $A_3$ through an inverter $I_1$. The output "1" of the delay flip-flop $DF_2$ is inverted by an inverter $I_2$ and is provided as an unblank signal UNB. This unblank signal UNB indicates that the same code as the key code KC is not stored in the key code memory 30 when it is "1," and that the same code as the key code KC is stored in the memory 30 when it is "0."

As described in the foregoing, storage or non-storage of the key code KC in the memory 30 is examined during production of the key data KD. The unblank signal UNB which indicates the result of the examination is applied to one input terminal of an AND circuit $A_4$ during the next one key time. The key data KD is delayed by one key time and applied to the other input terminal of the AND circuit $A_4$. Accordingly, when the unblank signal UNB is "1," the key data KD* is applied to one of the input terminals of an AND circuit $A_5$ via the AND circuit $A_4$.

In order for a new key code to be stored in the key code memory 30, at least one of the eight channels of the memory must be in a not-busy (empty) state, i.e., available for storage. A busy memory BUM is provided to detect whether there is a not-busy channel in the key code memory. The busy memory BUM consists of an 8-stage/1-bit shift register, and is adapted to store "1" when a new key-on signal NKO (to be described later) is applied thereto from the AND circuit $A_5$. This signal "1" is sequentially and cyclically shifted in the busy memory BUM. This new key-on signal is simultaneously applied to the key code memory 30 so as to cause the memory 30 to store the new key code. Accordingly, the signal "1" is stored in one of the channels of the busy memory BUM corresponding to the busy channel of the key code memory 30. Contents of a not-busy channel are "0." Thus, the output of the final stage of the busy memory BUM indicates whether this channel is busy or not. This output is hereinafter referred to as a busy signal AIS.

This busy signal AIS is applied to one of the input terminals of the AND circuit $A_5$ via an inverter. When the signal AIS is "0," i.e., a certain channel is not busy, the key data sigal is applied to the busy memory BUM as the new key-on signal via the AND circuit $A_5$ thereby causing the busy memory BUM to store "1" in its corresponding channel. Simultaneously, the gate G of the key code memory 30 is controlled so that the key code KCC from a delay flip-flop $DF_3$ will be stored in a not-busy channel of the memory 30.

The delay flip-flop $DF_3$ is provided for delaying the output KC of the key code generator 20 by one key time so that a key data code corresponding to the key KD may be stored in synchronization with the key data KD, since the key data KD which is delayed by one key time is applied to the key assigner.

The new key-on signal NKO from the AND circuit $A_5$ is applied through the OR circuit $OR_2$ to the delay flip-flop $DF_2$ to set the flip-flop, and the unblank signal UNB becomes "0." Accordingly, the output of the AND circuit $A_4$ becomes "0" when the unblank signal UNB becomes "0" thereby changing the new key-on signal NKO to "0." This arrangement is provided to ensure storage of the key codes KCC is only one, and not two or more, not-busy channel of the key code memory 30.

In this way, key codes are sequentially stored in the not-busy channels of the key code memory 30, and these key codes are delivered out of the memory 30 in time-shared sequence in response to the clock pulse $\phi_1$. Accordingly, the key codes KC* in the respective channels is provided at a very high rate which is equal to the repetition rate of the clock pulse $\phi_1$. The rate of the key codes KD* is converted to a lower rate in time-sharing rate converter 40.

The new key-on signal NKO is applied also to a key-on memory KOM consisting of an 8-stage/1 bit shift register and stored in a corresponding channel thereof in the form of a signal "1." This signal "1" is circulated at a period of one key time and also is provided as the output of the memory KOM in a time-sharing manner as the claim signal CLM which represents that the corresponding key is being depressed.

In the meantime, if the key code corresponding to the key is stored in the memory 30, the coincidence signal EQ produced from the corresponding channel of the coincidence detection memory EQM is "1" when the key data KD* of this key is produced from the delay flip-flop $DF_1$. This coincidence signal EQ is applied to one input of an AND circuit $A_6$. The key data which has become KD* through an inverter $I_3$ is applied to another input terminal of the AND circuit $A_6$. When the key data KD* has become "0" upon release of the key, the AND circuit $A_6$ produces a signal "1." This signal which represents release of the depressed key is applied to a corresponding channel of a key-off memory KFM consisting of an 8-stage/1-bit shift register. This signal "1" is circulated every one key time and also provided in a time-sharing manner as a release signal RLS which represents release of the key. The high channel clock pulse $\phi_1$ is used for both of the memories KOM and KFM.

A clear signal which is produced at a suitable time such as depression or release of a key or completion of reproduction of a tone is applied to a gate G of each memory, e.g., the busy memory BUM, to clear the contents of a corresponding channel of each memory.

Figure 4:
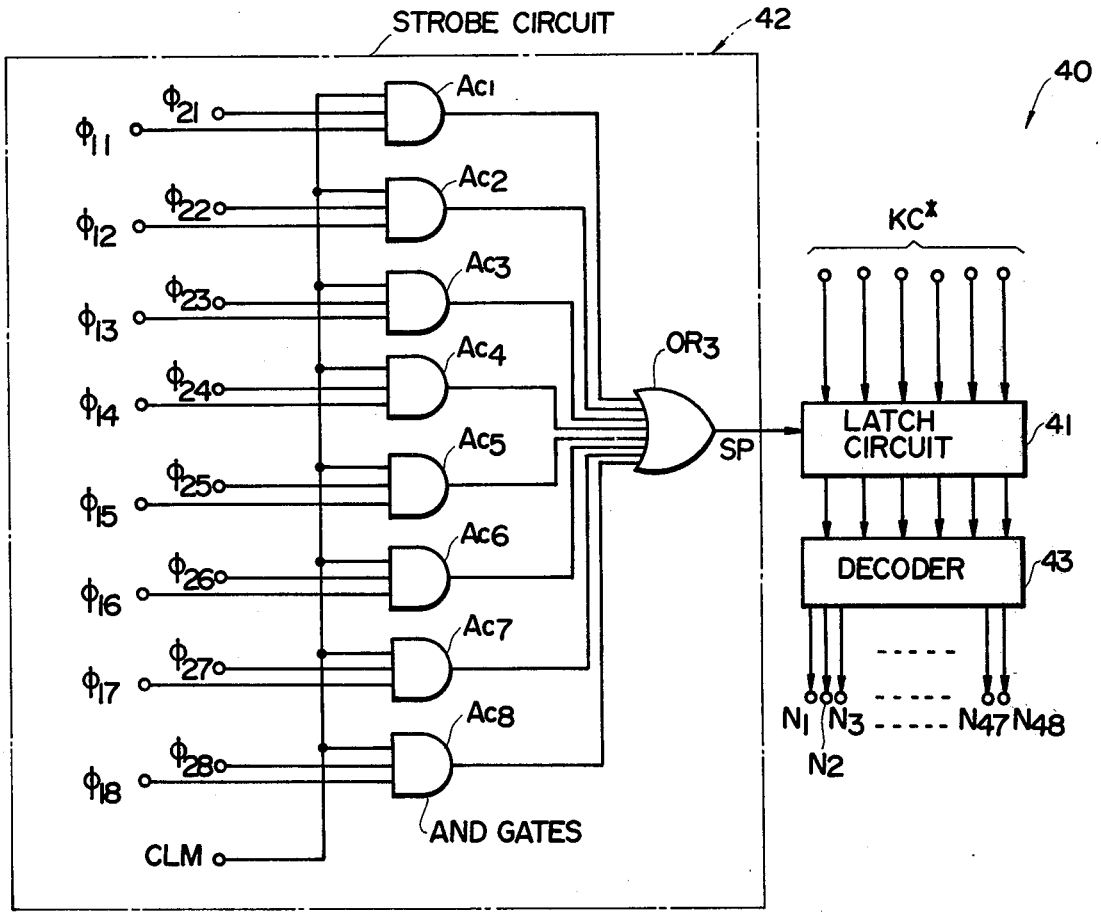
FIG. 4 is a block diagram showing the detail of a time-sharing rate converting apparatus.

Referring now to FIG. 4 which shows a block diagram of the time-sharing rate converting apparatus 40, the key codes KC* of the respective channels which are sent at a high time-sharing rate from the key code memory device 30 in accordance with the high channel clock pulse $\phi_1$ are successively applied to a latch circuit 41. A strobe circuit 42 generates a sampling pulse SP used for sampling the key codes KC* by the latch circuit 41 at a low rate. The strobe circuit 42 comprises a plurality of AND gate circuits $A_{c1}$ through $A_{c8}$ corresponding to the respective channels. These AND gate circuits are constructed to receive the first to eight high channel synchronizing clock pulses $\phi_{11}$ through $\phi_{18}$ and the first to eight low channel synchronizing clock pulses $\phi_{21}$, through $\phi_{28}$ respectively.

The sampling pulse SP is formed by repeatedly selecting, at a period of one key period, the first to eight high channel synchronizing clock pulses $\phi_{11}$ through $\phi_{18}$ in one low channel period of the corresponding low channel synchronizing clock pulses $\phi_{21}$–$\phi_{28}$ and then compounding the selected pulses by an OR gate circuit $OR_3$.

More particularly, when the first low channel synchronizing clock pulse $\phi_{21}$ which is applied to one input of the AND gate circuit $A_{c1}$ is generated during one low channel period (e.g. 5 ms) with the timing shown in FIG. 2*e*, the first high channel synchronizing clock pulse $\phi_{11}$ which is applied to the other input of the AND gate circuit $A_{c1}$ is repeatedly selected every key period and produced as the output of the AND gate circuit $A_{c1}$. Under these conditions the outputs from the other AND gate circuits $A_{c2}$ through $A_{c8}$ are zero. The pulse produced by the AND gate circuit $A_{c1}$ is applied to the sampling pulse input of the latch circuit 41 through an OR gate circuit $OR_3$. Since at this time the key code memory device 30 outputs the key code KC* which has been stored in the first channel, this key code of the first channel will be written in the latch circuit 41. The key code written in this manner is held for one key period until the next sampling pulse Sp is applied. In this manner, the key code of the first channel is repeatedly memorized and held by the latch circuit 41 every key period (e.g. 40 ms) during one low channel period.

In the same manner, each time the low channel synchronizing clock pulses $\phi_{22}$ through $\phi_{28}$ are produced the second through eight high channel synchronizing clock pulses $\phi_{12}$ through $\phi_{18}$ corresponding to the respective channels are selected for producing sampling pulses SP from OR gate circuit $OR_3$. Thus, in response to the generation of the low channel synchronizing clock pulses $\phi_{22}$ through $\phi_{28}$ shown in FIG. 2*e*, spaced sampling pulses SP are sequentially generated in synchronism with respective channel periods so as to successively store and hold in the latch circuit 41 only key codes KC* of channels corresponding to the low channel synchronizing clock pulses $\phi_{22}$ through $\phi_{28}$ during application of these clock pulses. In this manner, the key codes fed at a high rate and stored in the respective channels are sequentially sampled at spaced times according to the low rate sampling pulses SP and the sampled key codes are held for about one low channel period. For this reason, the time-sharing rate is converted from the high rate corresponding to one high channel period (e.g. 1 m) to the low rate corresponding to one low channel period (e.g. 5 ms).

The key codes of the respective channels multiplexed in time-sharing at the low rate are successively applied to a decoder 43 which generates the key gate control signals $N_1$ through $N_{48}$ for the respective channels in time-shared sequence, each key gate control signal having a width of one low channel period.

In an electronic musical instrument utilizing the key assigner of this invention, the key gate control signals $N_1$ through $N_{48}$ are applied to respective key gate circuits $KG_1$ through $KG_{48}$ corresponding to the respective keys for sampling the note voltages so that note voltage respectively representing the depressed key are sampled in time-sharing.

It should be understood that the note voltage determine the frequency of the musical tone and not whether the tone is to be produced or not. The key assigner of this invention is constructed such that it can produce a signal (called a claim signal) which represents whether a key of a particular channel has been depressed or not for controlling the generation of a musical tone. For the purpose of effecting the sampling of the note voltage and the control of the sound generation in a timed relationship, claim signals corresponding to the respective channels are applied to the inputs of the respective AND gate circuits $A_{c1}$ through $A_{c8}$ of the strobe circuit 42 as shown in FIG. 4 so that the sampling pulses SP are generated only during the time periods corresponding to the channels whose keys have been depressed.

With the circuit construction shown in FIG. 4, when converting key codes received at a high rate into key codes of a low rate, the key codes of the respective channels are sequentially latched by a signal latch circuit in accordance with a low rate sampling pulse instead of parallel latching key codes of the respective channels. Accordingly, the construction of the time-sharing rate converting apparatus is greatly simplified whereby the construction of the entire key assigner is simplified and cost of manufacturing the same can be remarkably reduced.

Figure 5:
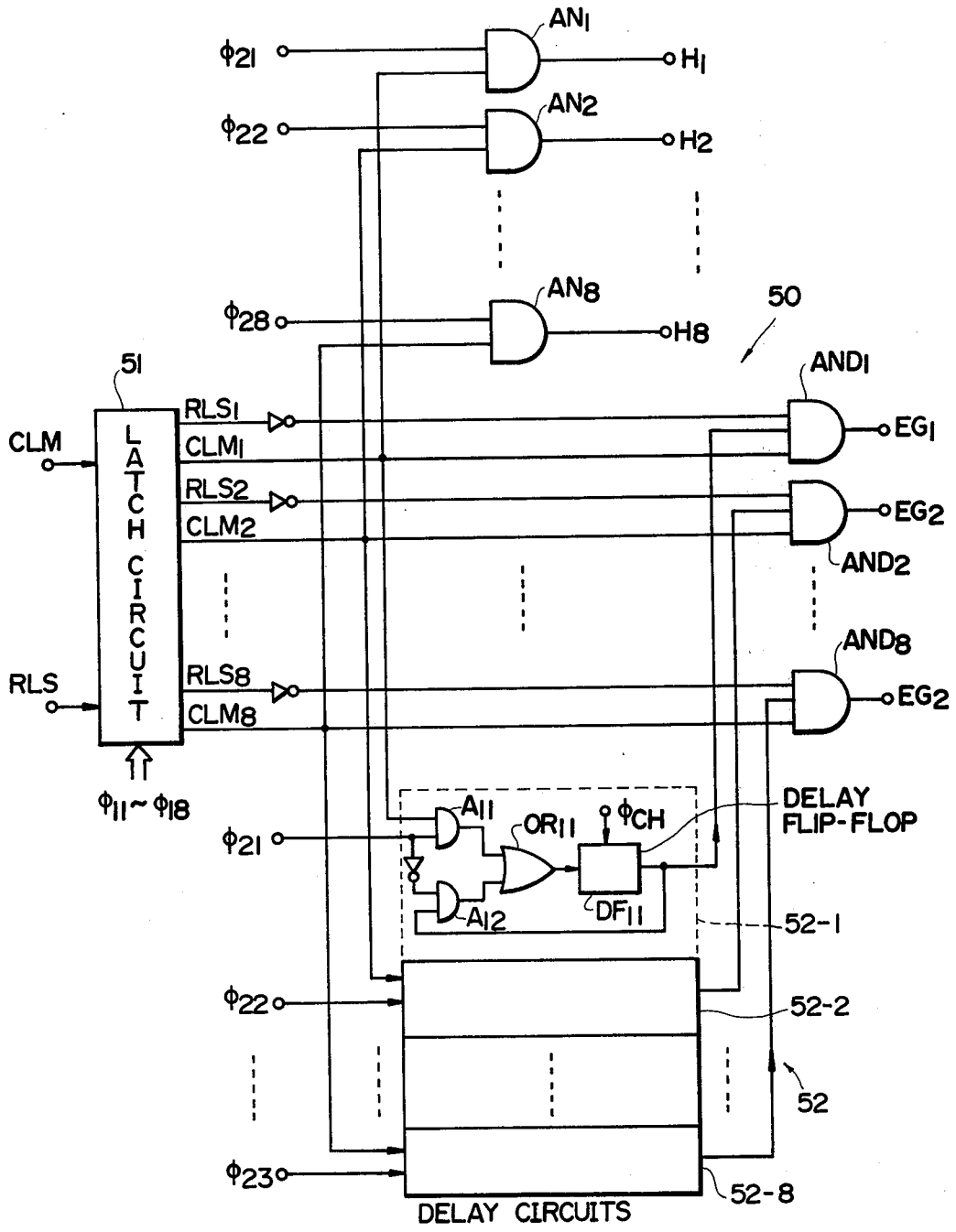
FIG. 5 is a block diagram showing one example of the envelope gate control signal generating circuit.

FIG. 5 is a block diagram showing one example of an envelope gate signal generating circuit 50 in which a latch circuit 51 is constructed such that the claim signal CLM and the release signal RLS respectively sent from the memory devices KOM and KFM (see FIG. 3) in a time-sharing manner are sampled in the respective channels in accordance with the first to eighth high channel synchronizing clock pulses $\phi_{11}$ through $\phi_{18}$, that the sampled signals are stored and held, and that the claim signals $CLM_1$ through $CLM_8$ and the release signals $RLS_1$ through $RLS_8$ are produced in parallel for each channel. The claim signal $CLM_1$ and the release signal $RLS_1$ correspond to the first channel and the claim signal $CLM_2$ and the release signal $RLS_2$ correspond to the second channel. In the same manner, the claim signals $CLM_3$–$CLM_8$ and the release signals $RLS_3$–$RLS_8$ correspond to the third to eighth channels, respectively.

The claim signals $CLM_1$ through $CLM_8$ of the respective channels are applied to one of the inputs of the respective AND gate circuits $AN_1$ through $AN_8$ and the other inputs of these AND gate circuits are connected to receive the first to eighth low channel synchronizing clock pulses $\phi_{21}$ through $\phi_{28}$, respectively. The AND gate circuits $AN_1$ through $AN_8$ which receive the claim signals corresponding to the channel of signal "1" produce output pulse signals having a width equal to one low channel period when these gate circuits receive corresponding synchronizing clock pulses $\phi_{21}$ through $\phi_{28}$.

Each of the first to eighth low channel synchronizing clock pulses $\phi_{21}$ through $\phi_{25}$ has a pulse width equal to one low channel period which generally corresponds to a time slot of the respective channels produced by the low rate time-sharing operation of the time-sharing rate converting apparatus 40. For this reason, where all the channels produce claim signals of "1" the AND gate circuits $AN_1$ through $AN_8$ successively produce pulses having a width of one low channel period which act as the channel gate control signals $H_1$ through $H_8$. In this manner, the channel gate control signals $H_1$ through $H_8$ are produced in a time-sharing sequence with a spacing of 1 low channel period. Accordingly, the key gate control signals $N_1$ through $N_{48}$ converting apparatus 40 and corresponding to the respective channels are always in synchronism with the channel gate control signals $H_1$ through $H_8$.

Claim signals $CLM_1$ through $CLM_8$ are applied to delay circuits 52-1 through 52-8 corresponding to the respective channels to be delayed by a predetermined time. The delayed signals are then applied to one of the inputs of AND gate circuits $AND_1$ through $AND_8$ for the respective channels. The other inputs of these AND gate circuits are connected to receive respective claim signals $CLM_1$ through $CLM_8$ directly from the latch circuit 51 and inverted release signals $RLS_1$ through $RLS_2$ through inverters. The delay time provided by the delay circuits 52-1 through 52-8 corresponds to the rise time of the charging voltage of capacitors $C_1$ through $C_8$ which are charged by sampling the note voltage in accordance with the key gate control signals $N_1$ through $N_{48}$ and channel gate control signals $H_1$ through $H_8$ and by charging the capacitor with the sampled voltage until their terminal voltages reach a definite note voltage. For this reason, it is sufficient to make the delay time to be nearly equal to the enabled or opened time of the gate circuits $CG_1$ through $CG_5$ utilized to sample the note voltage, that is the pulse width of the channel gate control signal which is equal to one low channel period.

Since the delay circuits 52-1 through 52-8 have the same construction, construction of the delay circuit 52-1 for the first channel is shown by way of example. The delay circuit 52-1 comprises two AND gate circuits $A_{11}$ and $A_{12}$ and one OR gate circuit $OR_{11}$ so as to delay the claim signal by one low channel period in accordance with the first low channel synchronizing clock pulse $\phi_{21}$. Respective delay circuits 52-1 through 52-8 are connected to respectively receive the first to eighth low channel synchronizing clock pulses $\phi_{21}$ through $\phi_{28}$ so that claim signals $CLM_1$ through $CLM_8$ are successively applied to the respective delay flip-flop circuits $DF_{11}$–$DF_{18}$ (only $DF_{11}$ is shown) with the timing of the low channel synchronizing clock pulses $\phi_{21}$ through $\phi_{28}$, respectively. As the respective delay flip-flop circuits are constructed to temporarily store input signals in accordance with the low channel synchronizing clock pulses, the respective claim signals $CLM_1$ through $CLM_8$ are delayed by one low channel period which is equal to the spacing of the low channel synchronizing clock pulses.

Since the respective low channel synchronizing clock pulses $\phi_{21}$ through $\phi_{28}$ are synchronized with the channel gate control signals $H_1$ through $H_8$ respectively, the delayed outputs are produced one low channel period later than the commencement of charging of the note voltage which is effected when the corresponding channel gates are enabled. Since the respective synchronizing clock pulses $\phi_{21}$ through $\phi_{28}$ are generated at a period of 8 low channel periods, the outputs of the delay flip-flop circuits are held by circulating them when the respective delay circuit 52-1 through 52-8 do not receive any corresponding synchronizing clock pulses $\phi_{21}$ through $\phi_{28}$ (signal 0). Thus, for example, in the delay circuit 52-1, the output from the delay flip-flop circuit $DF_{11}$ is circulated through an additional AND gate circuit $A_{12}$ and OR gate circuit $OR_{11}$.

The outputs from AND gate circuits $AND_1$ through $AND_8$ are utilized as the envelope gate control signals $EG_1$ through $EF_8$. In response to these envelope gate control signals, the envelope generators $EN_1$ through $EN_8$ (see FIG. 1) generate envelope control voltages which are applied to the voltage-controlled amplifiers $VCA_1$ through $VCA_8$ for controlling the generation of musical tones. The purpose of applying the release signals $RLS_1$ through $RLS_8$ to the respective AND gate circuits $AND_1$ through $AND_8$ is to immediately terminate the envelope control signals $EG_1$ through $EG_8$ whenever the keys have been released.

Thus, when a new key is depressed to change the state of the claim signal from "0" to "1," corresponding key gate circuit and channel gate circuit are enabled to commence the charging of a capacitor associated with the channel with the note voltage. However, since generation of the envelope control signals $EG_1$ and $EF_3$ is delayed by a predetermined time as described above, it is possible to produce musical tones having stable frequencies without being effected by the transient voltage which occurs at the time of charging the capacitor or the rise period of the terminal voltage thereof.

What is claimed is:

1. A key assigner for use in an electronic musical instrument, comprising first means for generating first time division multiplexed information representing depressed keys, and second means for converting said first time division multiplexed information into second time division multiplexed information at a time division rate which is slower than that at which said first time division multiplexed information is generated.

2. A key assigner according to claim 1, wherein said second means comprises a strobe circuit for producing strobe pulses one per one time slot of said slower time division rate and only at the time of a time slot of the faster time division rate corresponding to said one time slot of said slower time division rate, and a latch circuit connected to receive the respective outputs of said strobe circuit and of said first means and being operative upon receipt of said strobe pulses to store and hold said first time division multiplexed information.

3. A key assigner for use in an electronic musical instrument, comprising means for successively scanning all key switches of the musical instrument thereby producing key data which consists of a pulse existence at an assigned time slot and represents ON-OFF states of the respective key switches, means operated synchronously with said scanning operation for producing sequentially changing key codes corresponding to the respective key switches, key code memory means responsive to said key data for storing the key codes corresponding to the key switches which are turned ON in corresponding ones of channels equal in number to a maximum number of tones to be reproduced simultaneously, means for sequentially reading out the key codes of the respective channels from said key code memory means in time-sharing and in synchronism with said scanning operation, means for generating low rate sampling pulses which are synchronous in a spaced time relation with respective channel periods of a high time-sharing rate corresponding to said scanning, and means for successively storing and holding key codes of the channels which are read out of said key code memory means when said sampling pulses are applied.

4. A key assigner for use in an electronic musical instrument, comprising means for successively scanning all key switches of the musical instrument thereby producing key data which consists of a pulse existence at an assigned time slot and represents ON-OFF states of the respective key switches, means operated synchronously with said scanning operation for producing sequentially changing key codes corresponding to the respective key switches, key code memory means responsive to said key data for storing the key codes corresponding to the key switches which are turned ON in corresponding ones of channels equal in number to a maximum number of tones to be reproduced simultaneously, means for sequentially reading out the key codes of the respective channels from said key code memory means in time-sharing and in synchronism with said scanning operation, means for generating low rate sampling pulses which are synchronous in a spaced time relation with respective channel periods of a high time-sharing rate corresponding to said scanning, means for successively storing and holding key codes of the channels which are read out of said key code memory means when said sampling pulses are applied and means for decoding the key codes stored and held in said last mentioned means for producing key gate control signals.

5. The key assigner according to claim 4 which further comprises memory means for storing a signal representing the depression of a key in a channel associated with the depressed key in accordance with the memory of said key code, and means for delaying for a predetermined time the signal from said memory means thus producing an envelope gate signal.

6. The key assigner according to claim 4 wherein said means for generating low rate sampling pulses comprises a strobe circuit including means for producing by each channel a high channel synchronizing clock pulse having a pulse width of one high channel period in a time slot corresponding to the channel in one key time, means for producing by each channel a low channel synchronizing clock pulse having a pulse width of one low channel period obtained by dividing one low key period by the number of the channels in a time slot corresponding to the channel in said one low key period which is much longer than said one high key period, a plurality of AND gate circuits corresponding in number to the maximum number of tones to be reproduced simultaneously and each corresponding to one of the respective channels, means to apply a claim signal to the first inputs of said AND gate circuits, means to apply low channel synchronizing clock pulses to the second inputs of said AND gate circuits by each channel, means to apply high channel synchronizing clock pulses to the third inputs of said AND gate circuits by each channel, and an OR gate circits having a plurality of inputs respectively connected to the outputs of said AND gate circuits.

7. The key assigner according to claim 4 which further comprises memory means for storing a claim signal representing depression of the key in a channel associated with the depressed key in accordance with the stored contents of said key code, a latch circuit for sampling the claim signal which is sent from said memory in time-sharing for the respective channels in accordance with high channel synchronizing clock pulses, said latch circuit storing said sampled claim signal for parallely producing a plurality of claim signals for the respective channels; and a plurality of AND gate circuits of the same number as that of said channels, means to apply said claim signals to one inputs of said AND gate circuits respectively from said latch circuit, and means for applying to the other inputs of said AND gate circuits a plurality of low channel synchronizing clock pulses respectively whereby said AND gate circuits produce a plurality of channel gate control signals for respective channels.

8. The key assigner according to claim 7 which further comprises second memory means for storing a release signal representing release of the key in a channel associated with the released key in accordance with the stored contents of said key code, a second latch circuit for sampling the release signal which is sent from said second memory in time-sharing for the respective channels in accordance with high channel synchronizing clock pulses, a plurality of delay circuits connected to delay be a predetermined time said claim signals and a plurality of second AND gate circuits, means for applying to the first inputs of said second AND gate circuits said release signals provided from said second latch circuit, means for applying to the second inputs of said second AND gate circuits inverted release signals, and means for applying to the third inputs of said second AND gate circuits the output provided from said delay circuits respectively, whereby said second AND gate circuits produce envelope gate control signals for the respective channels.

* * * * *